US011205361B2

(12) United States Patent
Kim et al.

(10) Patent No.: US 11,205,361 B2
(45) Date of Patent: Dec. 21, 2021

(54) DISPLAY DRIVING DEVICE AND DISPLAY DEVICE INCLUDING THE SAME

(71) Applicant: Silicon Works Co., Ltd., Daejeon (KR)

(72) Inventors: Myung Yu Kim, Daejeon (KR); Do Seok Kim, Daejeon (KR); Hyun Pyo Cho, Daejeon (KR); Yong Hwan Moon, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/925,299

(22) Filed: Jul. 9, 2020

(65) Prior Publication Data

US 2021/0193004 A1 Jun. 24, 2021

(30) Foreign Application Priority Data

Dec. 24, 2019 (KR) ..... 10-2019-0174232

(51) Int. Cl.
*G09G 3/20* (2006.01)

(52) U.S. Cl.
CPC ..... *G09G 3/20* (2013.01); *G09G 3/2092* (2013.01); *G09G 2310/08* (2013.01); *G09G 2370/08* (2013.01); *G09G 2370/10* (2013.01)

(58) Field of Classification Search
None
See application file for complete search history.

(56) References Cited

U.S. PATENT DOCUMENTS

2006/0267925 A1* 11/2006 Sakamaki ..... G06F 3/1423 345/104
2007/0101398 A1* 5/2007 Islam ..... G02B 26/0808 725/151
2011/0242088 A1* 10/2011 Kim ..... G09G 3/3685 345/214
2017/0132966 A1* 5/2017 Lim ..... G09G 5/18
2019/0155432 A1* 5/2019 Park ..... G09G 3/3208
2020/0193884 A1* 6/2020 Kim ..... G09G 3/006

FOREIGN PATENT DOCUMENTS

KR 20160086949 B1 7/2016
KR 20170060422 A 6/2017
KR 20200030844 A 3/2020
KR 20200033628 A 3/2020

* cited by examiner

*Primary Examiner* — Dorothy Harris
(74) *Attorney, Agent, or Firm* — Polsinelli PC

(57) ABSTRACT

The present disclosure discloses a display driving device and a display device including the same, allowing high-speed data communication to be supported by controlling the length of a data packet. The display device may include a timing controller configured to transmit a communication signal, and a source driver connected to the timing controller through a communication link and configured to receive the communication signal. The source driver may receive the communication signal having a format of preamble data, start data, configuration data, end data, and configuration completion data from the timing controller in a configuration mode, and the configuration data may include a header defining a length of a data packet.

18 Claims, 4 Drawing Sheets

DISPLAY DRIVING DEVICE AND DISPLAY DEVICE INCLUDING THE SAME

CROSS-REFERENCE TO RELATED APPLICATION

This application claims priority to and the benefit of Korean Patent Application No. 2019-0174232, filed on Dec. 24, 2019, the disclosure of which is incorporated herein by reference in its entirety.

BACKGROUND

Field of the Invention

The present disclosure relates to a display device, and more particularly, to a display driving device and a display device including the same, which allow high-speed data communication to be supported.

Discussion of Related Art

Generally, display devices include a display panel, a source driver, a timing controller, and the like.

The source driver converts digital image data provided from the timing controller into data voltage and provides the data voltage to the display panel. The source driver may be integrated into an integrated circuit chip (IC chip) and may be configured as a plurality of IC chips in consideration of the size and resolution of the display panel.

Meanwhile, a display device sets an internal option of a source driver at low speed in order to communicate at high speed.

However, the number of configuration options required for high-speed communication may vary depending on an application and a source driver vendor. Accordingly, there is a problem in that a response speed of a display device is affected as the time required for the configuration proceeding at low speed increases.

SUMMARY OF THE INVENTION

The present disclosure is directed to providing a display driving device and a display device including the same, allowing high-speed data communication to be supported by controlling the length of a data packet.

According to an aspect of the present disclosure, there is provided a display device including a timing controller configured to transmit a communication signal, and a source driver connected to the timing controller through a communication link and configured to receive the communication signal. The source driver may receive the communication signal having a format of preamble data, start data, configuration data, end data, and configuration completion data from the timing controller in a configuration mode, and the configuration data may include a header defining a length of a data packet.

According to another aspect of the present disclosure, there is provided a display driving device including at least one source driver configured to receive a communication signal having a format of preamble data, start data, configuration data, end data, and configuration completion data from a timing controller in a configuration mode. The configuration data may include a header defining a length of a data packet.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Embodiments disclose a display driving device and a display device including the same, which allow the time for a configuration mode operating at a low frequency to be reduced by defining the length of a data packet, which is variable, in a header to support high-speed data communication.

Embodiments disclose a display driving device and a display device including the same, which enable a communication abnormal state to be restored to a normal state when a communication abnormality occurs due to an unexpected variable during communication between a timing controller and source drivers.

In embodiments, a restoration protocol or a recovery mode may be defined as a protocol or a mode that makes the communication states between a timing controller and source drivers in the same state.

In embodiments, a configuration protocol, a configuration mode, or a configuration period may be defined as a protocol, a mode, or a period for setting an option of Internet Protocol (IP) of communication links operating at high speed in a display mode, an option of a clock data recovery circuit of a source driver, an option for pre-clock training, and an equalizer option.

In embodiments, a display mode or a display period may be defined as a mode or a period for processing configuration data and image data of a source driver.

In embodiments, pre-clock training or a bandwidth setting period may be defined as a mode or a period for searching for and setting an optimal frequency bandwidth of communication links operating at high speed in a display mode.

In embodiments, equalizer training or an equalizer period may be defined as a mode or a period for setting an equalizer gain level to improve the characteristics of communication links operating at high speed in a display mode.

In embodiments, terms "first," "second," and the like may be used for the purpose of distinguishing a plurality of elements from one another. Here, the terms "first," "second," and the like are not intended to limit the elements.

Figure 1:
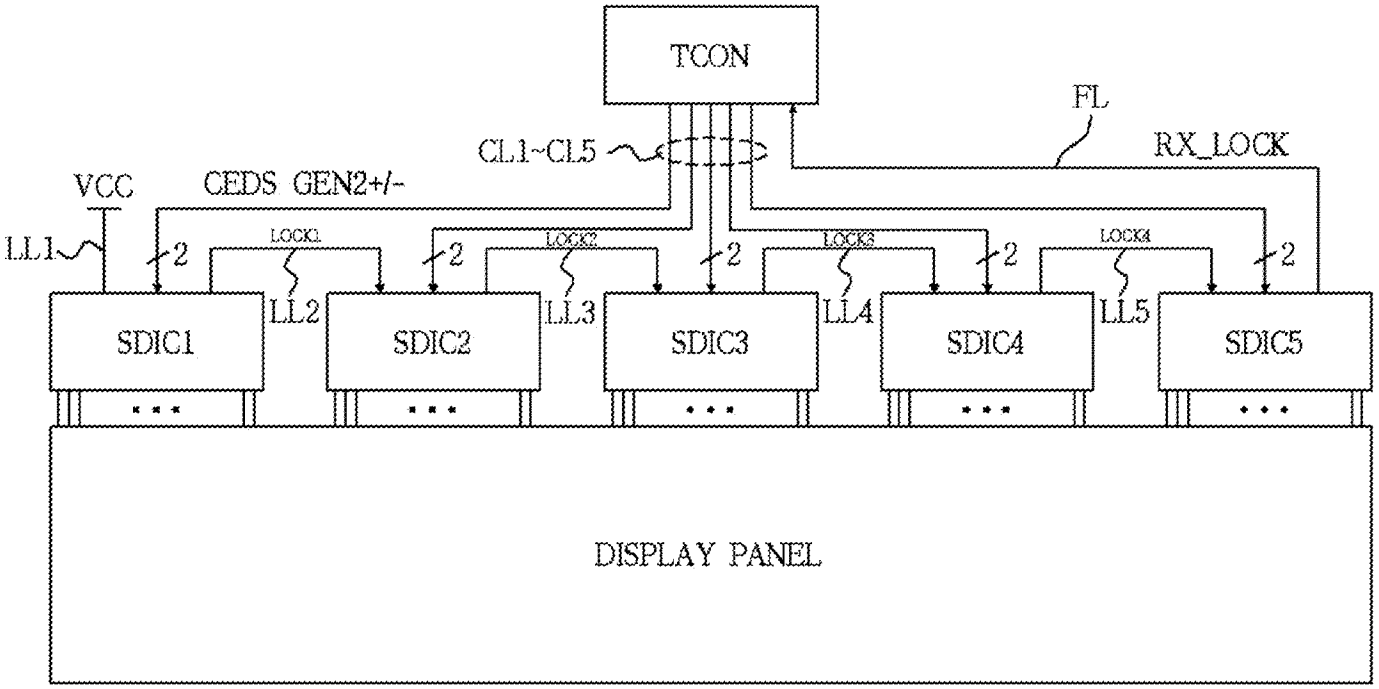
FIG. 1 is a block diagram of a display device according to one embodiment.

FIG. 1 is a block diagram of a display device according to one embodiment.

Referring to FIG. 1, the display device may include a timing controller TCON, a plurality of first to fifth source drivers SDIC1 to SDIC5, and a display panel.

The timing controller TCON may be connected to the plurality of first to fifth source drivers SDIC1 to SDIC5 through first to fifth communication links CL1 to CL5 in a point-to-point manner.

As an example, the timing controller TCON may be connected to the first source driver SDIC1 through the first communication link CL1, and the timing controller TCON may be connected to the second source driver SDIC2 through the second communication link CL2. The timing controller TCON may be connected to the third source driver SDIC3 through the third communication link CL3, and the timing controller TCON may be connected to the fourth source driver SDIC4 through the fourth communication link CL4. The timing controller TCON may be connected to the fifth source driver SDIC5 through the fifth communication link CL5. In addition, each of the first to fifth communication links CL1 to CL5 may be configured as a pair of differential signal lanes.

The timing controller TCON may provide a communication signal CEDS GEN2+/− to the source drivers SDIC1 to SDIC5 through the first to fifth communication links CL1 to CL5, respectively.

In addition, the first to fifth source drivers SDIC1 to SDIC5 may be connected to each other through first to fifth lock links LL1 to LL5 in a cascade manner.

As an example, a power voltage terminal VCC may be connected to the first source driver SDIC1 through the first lock link LL1. The first source driver SDIC1 may be connected to the second source driver SDIC2 through the second lock link LL2, and the second source driver SDIC2 may be connected to the third source driver SDIC3 through the third lock link LL3. The third source driver SDIC3 may be connected to the fourth source driver SDIC4 through the fourth lock link LL4, and the fourth source driver SDIC4 may be connected to the fifth source driver SDIC5 through the fifth lock link LL5. In addition, the fifth source driver SDIC5, which is the last one, may be connected to the timing controller TCON through a feedback link FL.

The first source driver SDIC1 may transmit a first lock signal LOCK1 to the second source driver SDIC2 through the second lock link LL2, and the second source driver SDIC2 may transmit a second lock signal LOCK2 to the third source driver SDIC3 through the third lock link LL3. The third source driver SDIC3 may transmit a third lock signal LOCK3 to the fourth source driver SDIC4 through the fourth lock link LL4, and the fourth source driver SDIC4 may transmit a fourth lock signal LOCK4 to the fifth source driver SDIC5 through the fifth lock link LL5. In addition, the fifth source driver SDIC5 may transmit a fifth lock signal RX_LOCK to the timing controller TCON through the feedback link FL. Here, the fifth lock signal RX_LOCK may indicate a communication state of at least one of the first to fifth source drivers SDIC1 to SDIC5. The fifth lock signal RX_LOCK may be switched to have a value indicating a communication abnormal state when a lock failure occurs in at least one of the first to fifth source drivers SDIC1 to SDIC5.

Figure 2:
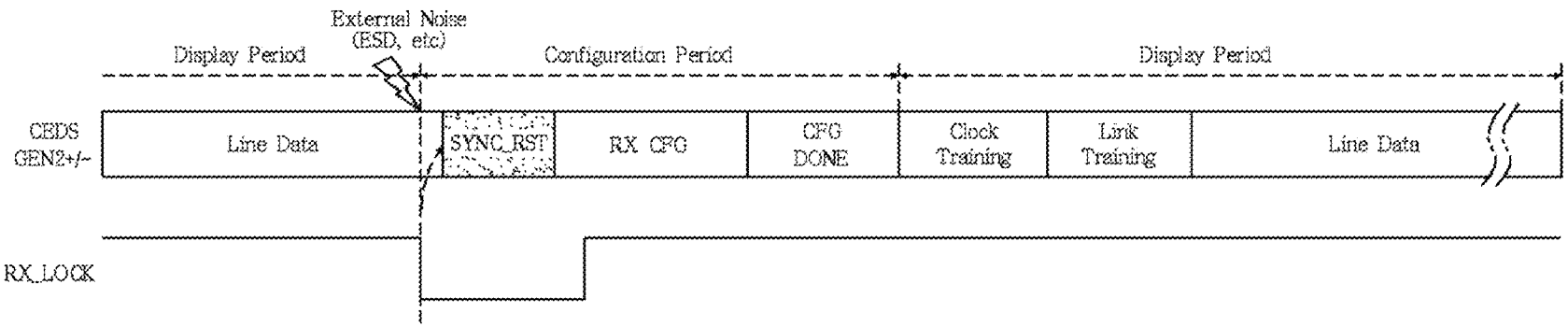
FIG. 2 is a diagram for describing a restoration protocol of the display device according to one embodiment.

FIG. 2 is a diagram for describing a restoration protocol of the display device according to one embodiment.

Referring to FIG. 2, when the communication abnormal state occurs due to external noise such as an electrostatic discharge (ESD) while performing a display mode, the display device may be switched from the display mode to a configuration mode.

As an example, when a lock failure occurs in at least one of the first to fifth source drivers SDIC1 to SDIC5, the fifth source driver SDIC5 may switch the level of the fifth lock signal RX_LOCK from a high level to a low level and provide the fifth lock signal RX_LOCK to the timing controller TCON.

When the lock failure occurs, the timing controller TCON may include a restore command SYNC_RST, for restoring the communication state, in the communication signal CEDS GEN2+/− and transmit the communication signal CEDS GEN2+/− to the first to fifth source drivers SDIC1 to SDIC5 through the first to fifth communication links CL1 to CL5.

As an example, the timing controller TCON may transmit the restore command SYNC_RST having a predetermined level for a predetermined period of time. In addition, the timing controller TCON may transmit a configuration data packet RX CFG to the first to fifth source drivers SDIC1 to SDIC5 after transmitting the restore command SYNC_RST for the predetermined period of time.

The first to fifth source drivers SDIC1 to SDIC5 may receive the restore command SYNC_RST and the configuration data packet RX CFG, and may perform a configuration mode according to the configuration data packet RX CFG. Here, the configuration mode may be defined as a mode for setting an IP option of the first to fifth communication links CL1 to CL5 operating at high speed in the display mode.

In addition, the configuration mode may be set to operate in a low-frequency band compared to the display mode.

In addition, the timing controller TCON may transmit configuration completion data CFG DONE to the first to fifth source drivers SDIC1 to SDIC5 after transmitting the entire configuration data packet RX CFG.

As an example, the timing controller TCON may transmit the configuration completion data CFG DONE, which has a value in which 0 and 1 are continuously toggled for a predetermined period of time, to the first to fifth source drivers SDIC1 to SDIC5.

In addition, when the first to fifth source drivers SDIC1 to SDIC5 receive the configuration completion data CFG DONE from the timing controller TCON, the first to fifth source drivers SDIC1 to SDIC5 may be switched from the configuration mode to the display mode.

The first to fifth source drivers SDIC1 to SDIC5 may restore a phase lock loop (PLL) clock of an internal clock data recovery circuit (not shown) by performing clock training in a display period.

Next, after the clock training in the display period, the first to fifth source drivers SDIC1 to SDIC5 may lock symbol boundary detection and a symbol clock by performing link training.

Next, after the link training in the display period, the first to fifth source drivers SDIC1 to SDIC5 may receive frame data transmitted from the timing controller TCON, convert line data included in the frame data into a data voltage, and provide the data voltage to the display panel.

Figure 3:
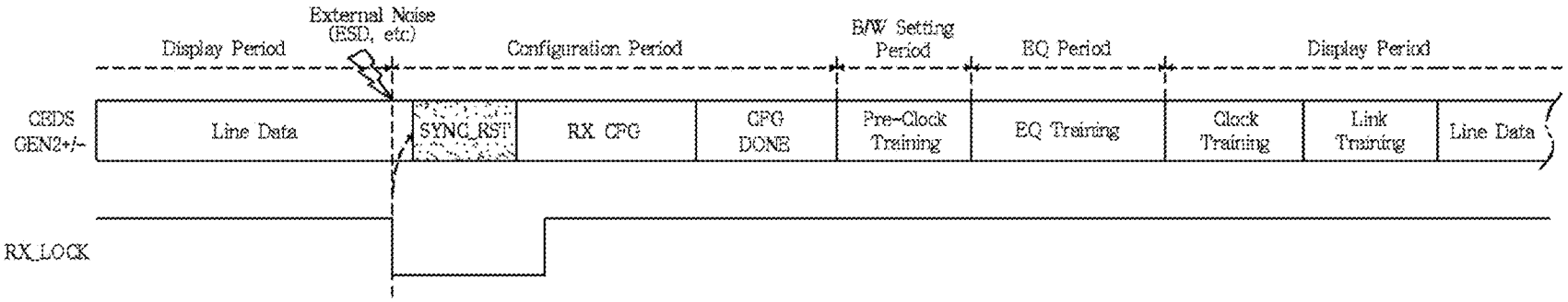
FIG. 3 is a diagram for describing a restoration protocol of a display device according to another embodiment.

FIG. 3 is a diagram for describing a restoration protocol of a display device according to another embodiment. In describing FIG. 3, the description that overlaps that of the embodiment described with reference to FIG. 2 is replaced by the description of FIG. 2.

Referring to FIG. 3, when a communication abnormal state occurs due to external noise, the timing controller TCON may transmit a restore command SYNC_RST having a predetermined level to the first to fifth source drivers SDIC1 to SDIC5 for a predetermined period of time.

Next, after the restore command SYNC_RST is transmitted for the predetermined period of time, the timing controller TCON may transmit a configuration data packet RX CFG to the first to fifth source drivers SDIC1 to SDIC5.

As an example, the timing controller TCON may include a pre-clock training option and an equalizer training option in the configuration data packet RX CFG when transmitting the configuration data packet RX CFG to the first to fifth source drivers SDIC1 to SDIC5.

Next, after a configuration mode is completed, the first to fifth source drivers SDIC1 to SDIC5 may perform pre-clock training to set an optimal frequency bandwidth of the first to fifth communication links CL1 to CL5 operating at high speed in a display mode.

Next, after the pre-clock training is completed, the first to fifth source drivers SDIC1 to SDIC5 may perform equalizer training to set an equalizer gain level in which the characteristics of the communication links operating at high speed in the display mode may be improved.

As an example, the timing controller TCON may repeatedly transmit the pattern of equalizer clock training and equalizer link training during an equalizer period as many times as set in the previous configuration mode.

The first to fifth source drivers SDIC1 to SDIC5 may change the level of the equalizer gain level by a value set in the previous configuration mode.

In addition, each of the first to fifth source drivers SDIC1 to SDIC5 may check locking, symbol locking, and the number of errors of the clock data recovery circuit according to the equalizer gain level thereof.

In addition, the first to fifth source drivers SDIC1 to SDIC5 may compare locking, symbol locking, and the number of errors of the clock data recovery circuit according to the equalizer gain level to select the most effective equalizer gain level, and set the first to fifth communication links CL1 to CL5 accordingly.

Here, the pre-clock training and the equalizer training may be set to operate in a high-frequency band compared to the configuration mode.

In addition, the first to fifth source drivers SDIC1 to SDIC5 may be switched to the display mode after completing the equalizer training.

The first to fifth source drivers SDIC1 to SDIC5 may restore a PLL clock by performing the clock training in the display mode, and may lock symbol boundary detection and a symbol clock by performing the link training.

In addition, the first to fifth source drivers SDIC1 to SDIC5 may convert line data transmitted from the timing controller TCON into a data voltage, and provide the data voltage to the display panel.

As described above, according to the embodiments, when the communication abnormality occurs between the timing controller and the source driver due to unexpected variables, the communication abnormal state may be restored to a normal state at the desired time, thereby preventing a communication failure.

Figure 4:
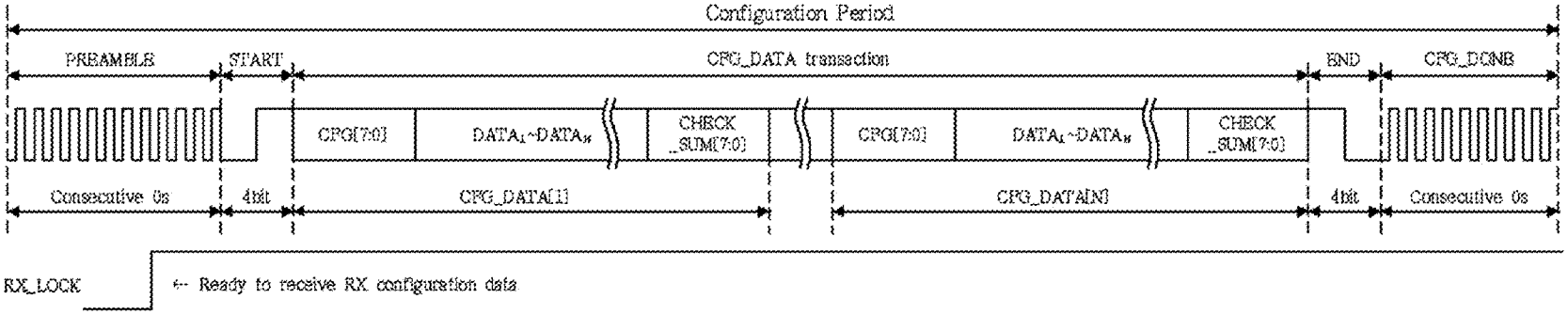
FIG. 4 is a diagram for describing a configuration protocol of the display device according to one embodiment.

FIG. 4 is a diagram for describing a configuration protocol of the display device according to one embodiment. Hereinafter, for convenience of explanation, a case in which communication is performed between the timing controller and one source driver will be described as an example.

Referring to FIG. 4, the source driver may receive a communication signal having a format of preamble data PREAMBLE, start data START, configuration data CFG_DATA, end data END, and configuration completion data CFG_DONE from the timing controller TCON in a configuration mode. The configuration data CFG_DATA may include a header CFG[7:0] that defines the length of data packets DATA1 to DATAN.

The configuration data CFG_DATA may have a format of the header CFG[7:0], the data packets DATA1 to DATAN, and a checksum CHECK_SUM[7:0].

The header CFG[7:0] may define the number of bytes of the data packets DATA1 to DATAN of the current transaction. In addition, the header CFG[7:0] may define the total number of sequences CFG_DATA[1] to CFG_DATA[N] of the configuration data CFG_DATA. In addition, the header CFG[7:0] may define whether the checksum CHECK_SUM [7:0] is activated.

As an example, the header CFG[7:0] may be composed of 8 bits, and a [0] bit of the header CFG[7:0] may be used for synchronization, [3:1] bits of the header CFG[7:0] may be used to define the number of bytes of the data packets DATA1 to DATAN of the current transaction, [6:4] bits of the header CFG[7:0] may be used to define the total number of the sequences CFG_DATA[1] to CFG_DATA[N] of the configuration data CFG_DATA. In addition, a [7] bit of the header CFG[7:0] may define whether the checksum CHECK_SUM[7:0] is activated.

First, the source driver may receive the preamble data PREAMBLE, which is continuously toggled between levels of 0 and 1, in the configuration mode.

Next, when the source driver continuously receives the preamble data PREAMBLE for a predetermined period of time, the source driver may transmit a lock signal RX_LOCK indicating that the source driver is ready to receive the configuration data CFG_DATA to the timing controller TCON. As an example, the source driver may provide the lock signal RX_LOCK by switching from a low level to a high level.

Next, the timing controller TCON may transmit the start data START, the configuration data CFG_DATA, the end data END, and the configuration completion data CFG_DONE to the source driver in response to the lock signal RX_LOCK. Here, the start data START may be set to a level of "0011," and the end data END may be set to a level of "1100."

Next, after the end data END of "1100" is received, the source driver may receive the configuration completion data CFG_DONE continuously toggled between levels of 0 and 1.

Next, when the source driver receives the configuration completion data CFG_DONE for a predetermined period of time, the source driver may perform pre-clock training, equalizer training, or a display mode according to the configuration data CFG_DATA.

As described above, according to the embodiments, the time for a configuration mode operating at a low frequency can be reduced by defining the length of a data packet, which is variable, in a header, thereby supporting high-speed data communication and improving system efficiency.

What is claimed is:

1. A display device comprising:

a timing controller configured to transmit a communication signal; and a source driver connected to the timing controller through a communication link and configured to receive the communication signal, wherein the source driver receives the communication signal having a format of preamble data, start data, configuration data, end data, and configuration completion data from the timing controller in a configuration mode, and the configuration data includes a header defining a length of a data packet.

2. The display device of claim 1, wherein the configuration data has a format of the header, the data packet, and a checksum, and the header defines the number of bytes of the data packet of current transaction.

3. The display device of claim 2, wherein the header further defines a total number of sequences of the configuration data.

4. The display device of claim 3, wherein the header further defines whether the checksum is activated.

5. The display device of claim 1, wherein the source driver receives the preamble data that is continuously toggled between levels of 0 and 1.

6. The display device of claim 5, wherein, when the preamble data is received for a predetermined period of time, the source driver transmits a lock signal indicating that the source driver is ready to receive the configuration data to the timing controller.

7. The display device of claim 6, wherein the timing controller transmits the start data, the configuration data, the end data, and the configuration completion data to the source driver in response to the lock signal.

8. The display device of claim 1, wherein the configuration data includes:

the header defining at least one or more of the number of bytes of a data packet of current transaction, a total number of sequences of the configuration data, and whether a checksum is activated;

the data packet including configuration options; and the checksum for checking an error of the data packet.

9. The display device of claim 1, wherein the start data is set to have a level of "0011," and the end data is set to have a level of "1100".

10. The display device of claim 9, wherein, after the end data is received, the source driver receives the configuration completion data that is continuously toggled between levels of 0 and 1.

11. The display device of claim 10, wherein, when the source driver receives the configuration completion data for a predetermined period of time, the source driver performs pre-clock training, equalizer training, or a display mode according to the configuration data.

12. A display driving device comprising at least one source driver configured to receive a communication signal having a format of preamble data, start data, configuration data, end data, and configuration completion data from a timing controller in a configuration mode, wherein the configuration data includes a header defining a length of a data packet.

13. The display driving device of claim 12, wherein the configuration data includes:

the header defining at least one or more of the number of bytes of a data packet of current transaction, a total number of sequences of the configuration data, and whether a checksum is activated;

the data packet including configuration options; and the checksum for checking an error of the data packet.

14. The display driving device of claim 12, wherein the source driver receives the preamble data that is continuously toggled between levels of 0 and 1.

15. The display driving device of claim 14, wherein, when the preamble data is received for a predetermined period of time, the source driver transmits a lock signal indicating that the source driver is ready to receive the configuration data to the timing controller.

16. The display driving device of claim 12, wherein the start data is set to have a level of "0011," and the end data is set to have a level of "1100".

17. The display driving device of claim 16, wherein, after the end data is received, the source driver receives the configuration completion data that is continuously toggled between levels of 0 and 1.

18. The display driving device of claim 17, wherein, when the source driver receives the configuration completion data for a predetermined period of time, the source driver performs pre-clock training, equalizer training, or a display mode according to the configuration data.

* * * * *